US006666714B1

(12) United States Patent
Li et al.

(10) Patent No.: US 6,666,714 B1
(45) Date of Patent: Dec. 23, 2003

(54) ELECTRICAL CONNECTOR WITH TERMINAL PROTECTOR

(75) Inventors: Chun Sheng Li, Kunsan (CN); Qiang Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/290,123

(22) Filed: Nov. 6, 2002

(51) Int. Cl.[7] ..... H01R 13/52; H01R 13/60; H01R 13/66; H01R 13/44

(52) U.S. Cl. ..... 439/521; 439/541.5; 439/149

(58) Field of Search ..... 439/521, 541.5, 439/881, 608, 607, 135, 528, 149

(56) References Cited

U.S. PATENT DOCUMENTS 4,461,528 A * 7/1984 Durand et al. ..... 439/409
4,632,495 A * 12/1986 Furman ..... 439/660
5,167,531 A * 12/1992 Broschard et al. ..... 439/541.5
5,256,072 A * 10/1993 Hatagishi ..... 439/79
6,224,419 B1 * 5/2001 Tucker et al. ..... 439/521
6,244,901 B1 * 6/2001 Fujii et al. ..... 439/596
6,280,217 B1 * 8/2001 Lin ..... 439/260
6,312,282 B1 * 11/2001 Blaha et al. ..... 439/402
6,361,353 B1 * 3/2002 Saka et al. ..... 439/405
2001/0029129 A1 * 10/2001 Sawayanagi et al. ..... 439/596

* cited by examiner

*Primary Examiner*—Chandrika Prasad
(74) *Attorney, Agent, or Firm*—Wei Te Chung

(57) ABSTRACT

An electrical connector (1) comprises an insulative housing (10), a plurality of terminals (20) received in the housing, and an insulative protector (30). The insulative housing comprises a mating portion (11), a plurality of terminal receiving passageways (13) defined in the mating portion, a pair of sidewalls (14) extending rearwardly from the mating portion and a pair of platforms (16) respectively formed outside of the sidewalls. The protector (30) comprises a top ledge (31) having a pair of tongues (311) formed on opposite ends thereof, and a base (32) having a pair of opposite side latches (321) at the bottom thereof. Each latch has a hook (322) formed at the free end thereof. The tongues of the top ledge and the latches of the base engage the sidewalls of the insulative housing to assemble the insulative protector to the insulative housing.

11 Claims, 6 Drawing Sheets

ELECTRICAL CONNECTOR WITH TERMINAL PROTECTOR

FIELD OF THE INVENTION

The present invention relates to an electrical connector having right-angle bent terminals, and particularly to an electrical connector having an insulative protector for covering and protecting the terminals.

DESCRIPTION OF THE PRIOR ART

Electrical connectors with a large number of electrical contacts are often used in electrical computers, particularly large computers which produce a high number of transmission signals. To save the space, headers having electrical terminals bent at an angle of approximately 90° from the end of the header are commonly used in the electrical and electronic industry as, for example, on the end of a circuit board. The electrical terminals are usually unprotected and are subject to damage and may collect dust and debris which could interfere with the electrical operations.

Thus, there is a need for a simple, cost effective means to effectively shield the right angle bend electrical terminals to protect persons using electrical equipment from receiving an electrical shock when touching the exposed electrical terminals and to reduce the accumulation of the dust and debris on the electrical terminals. Hence, an improved electrical connector is required to overcome the disadvantages of the prior art.

SUMMARY OF THE INVENTION

Accordingly, an object of the present invention is to provide an improved electrical connector which has a protector steadily assembled to an insulative housing thereof so as to protect a plurality of terminals of the electrical connector and ensure the signal transmission.

To achieve the above object, an electrical connector in accordance with the present invention comprises an insulative housing, a plurality of terminals received in the housing, and an insulative protector. The insulative housing comprises a mating portion having a rear face, a plurality of terminal receiving passageways defined in the mating portion, a pair of sidewalls extending rearwardly from the mating portion and a pair of platforms respectively formed outside of the sidewalls. The protector comprises a top ledge having a pair of tongues formed on opposite ends thereof, and a base having a pair of opposite side latches at the bottom thereof. Each latch has a hook formed at the free end thereof. The tongues of the top ledge and the latches of the base engage the sidewalls of the insulative housing to assemble the insulative protector to the insulative housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
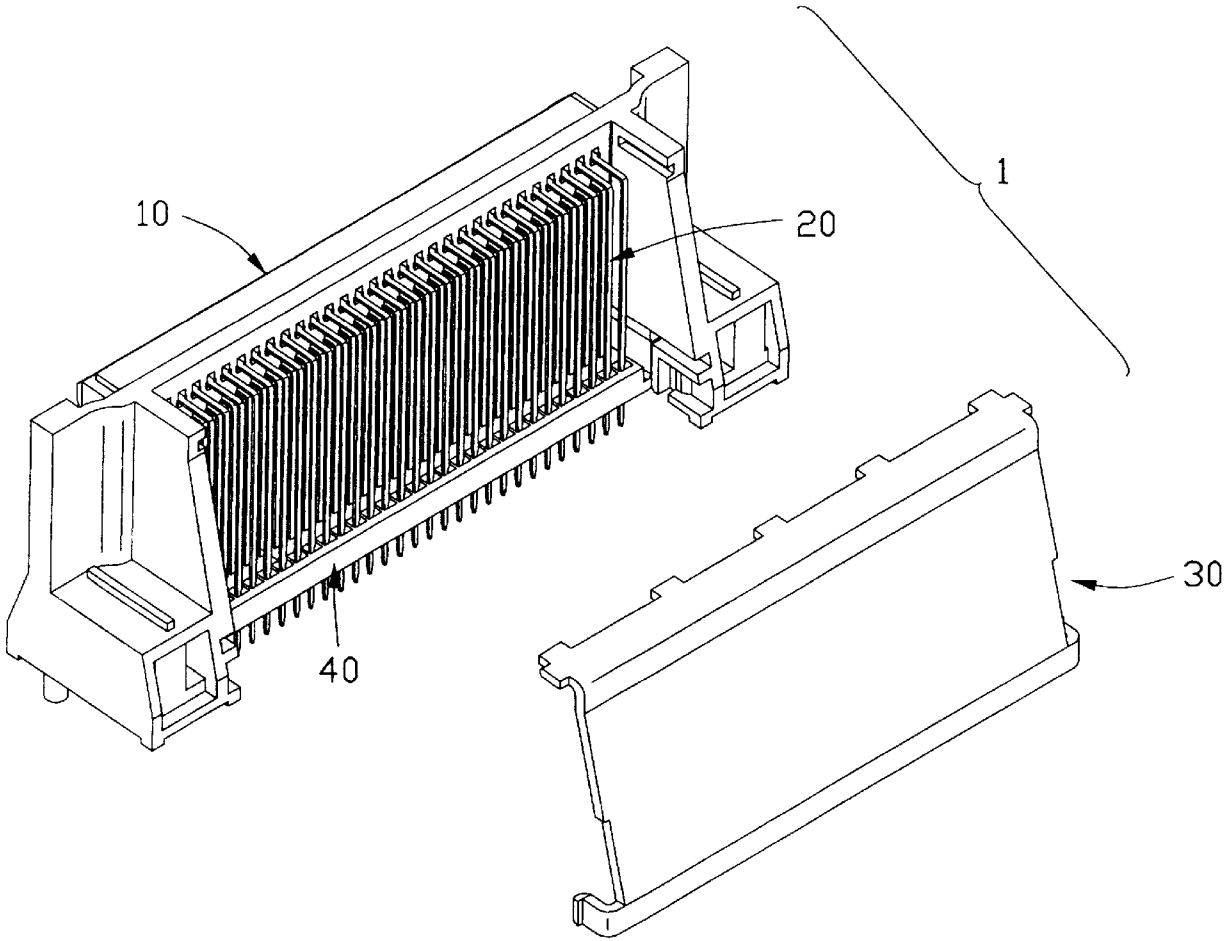
FIG. 1 is an exploded perspective view of an electrical connector in accordance with the present invention.

With reference to the drawings and particularly to FIGS. 1–5, an electrical connector 1 of the present invention comprises an insulative housing 10, a plurality of terminals 20, a protector 30 protecting the terminals 20, a spacer 40, and a pair of board locks 50.

Figure 2:
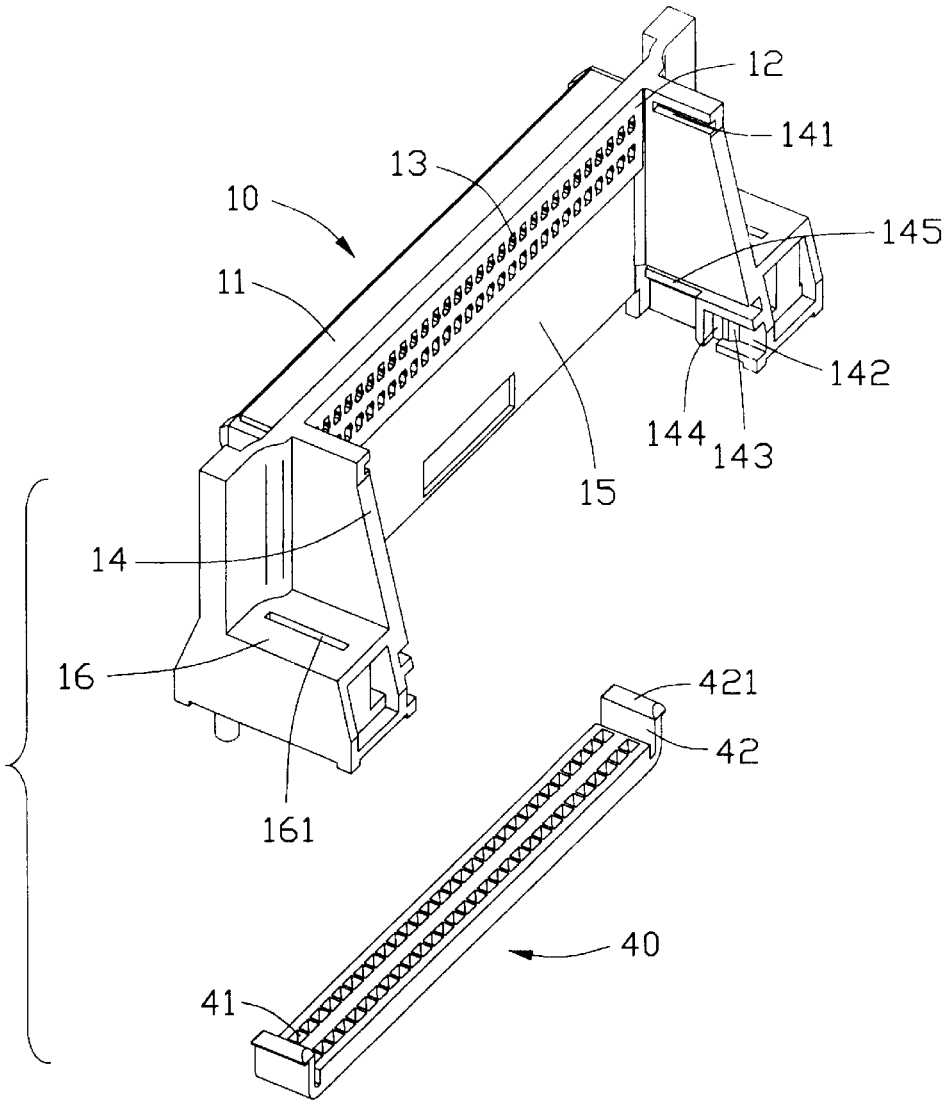
FIG. 2 is a perspective view of an insulative housing and a spacer of the electrical connector of the present invention.

Referring to FIG. 2, the insulative housing 10 comprises a mating portion 11 having a rear face 12 for mating with a complementary connector (not shown), a plurality of terminal receiving passageways 13 defined in the mating portion 11, a pair of trapezium-shaped sidewalls 14 extending rearwardly from the mating portion 11, and a pair of platforms 16 respectively formed outside of the sidewalls 14. A space 15 is defined between the two sidewalls 14 and the rear face 12 of the mating portion 11 for receiving the protector 30. Each sidewall 14 defines a slot 141 in the top thereof, a recess 145 in the bottom thereof and an opening 142 in rear of the recess 145. A protrusion 143 and a groove 144 are disposed in the opening 142. Each platform 16 defines a slit 161 therethrough for receiving a corresponding board lock 50. Also referring to FIG. 4, the insulative housing 10 comprises a pair of opposite posts 18 at the bottom thereof to position the electrical connector 1 on a printed circuit board (not shown). The spacer 40 is elongated and comprises a plurality of through holes 41 and a pair of arms 42 respectively formed at opposite ends thereof. Each arm 42 has a catch 421.

Figure 3:
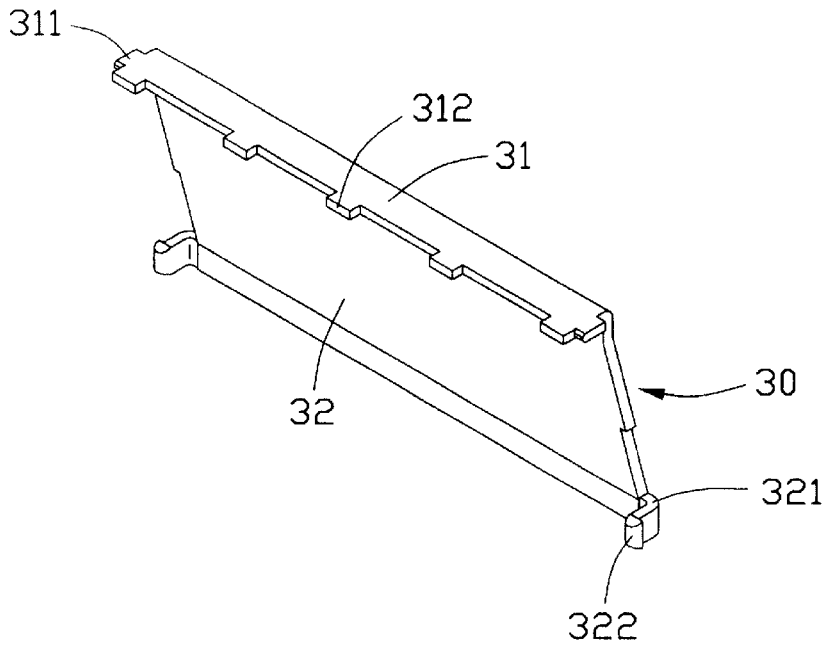
FIG. 3 is a perspective view of an insulative protector of the electrical connector.
Figure 4:
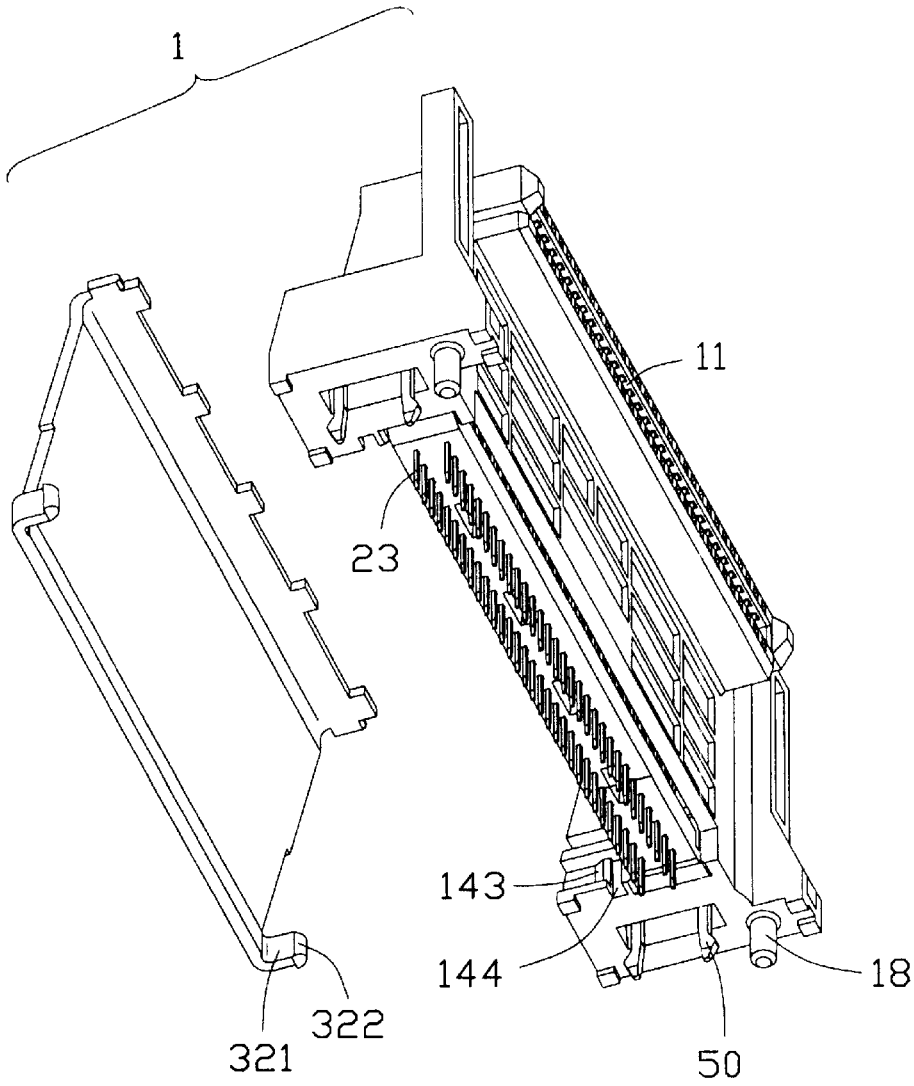
FIG. 4 is another exploded perspective view of the electrical connector of the present invention, viewed from front and bottom aspects.
Figure 5:
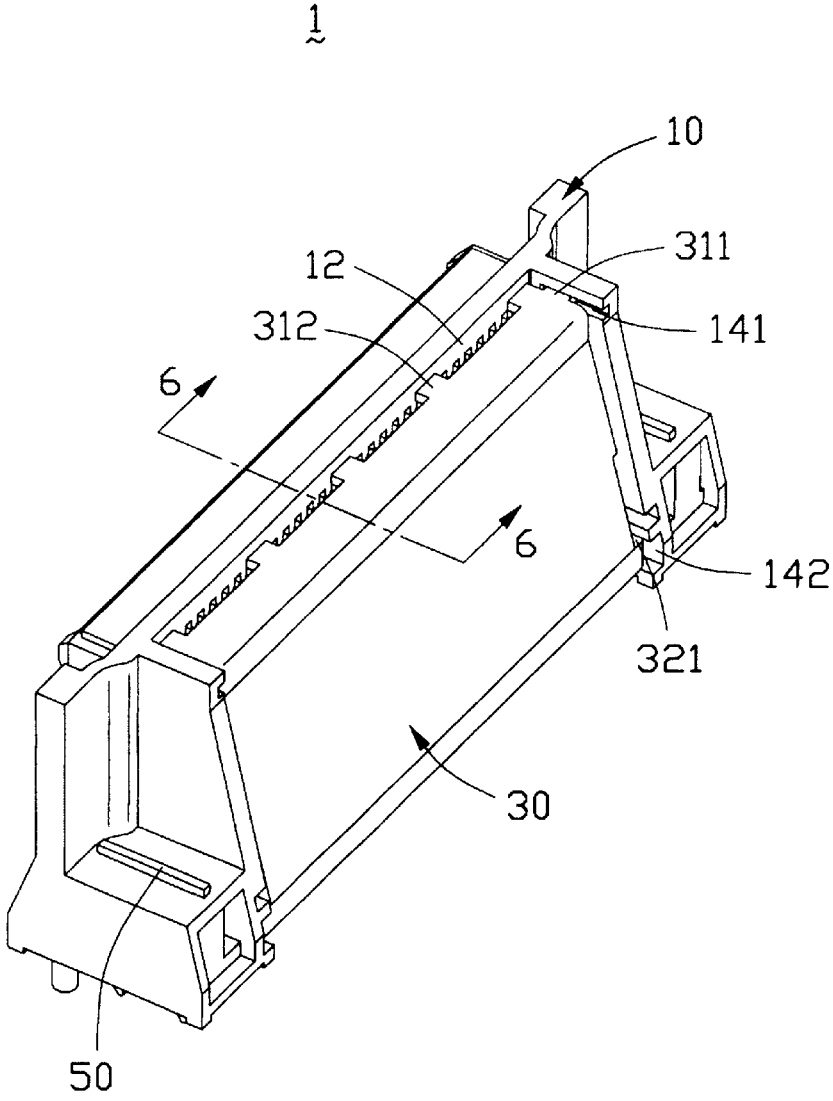
FIG. 5 is an assembled perspective view of FIG. 1.

Referring to FIG. 3, the protector 30 is substantially an insulative panel, and comprises a base 32 and a top ledge 31 projecting from the base 32. The top ledge 31 has a pair of tongues 311 respectively projecting from opposite ends thereof and a plurality of stoppers 312 projecting from a front edge thereof. The base 32 has a pair of opposite side latches 321 at the bottom thereof. Each latch 321 has a hook 322 at the free end thereof.

Figure 6:
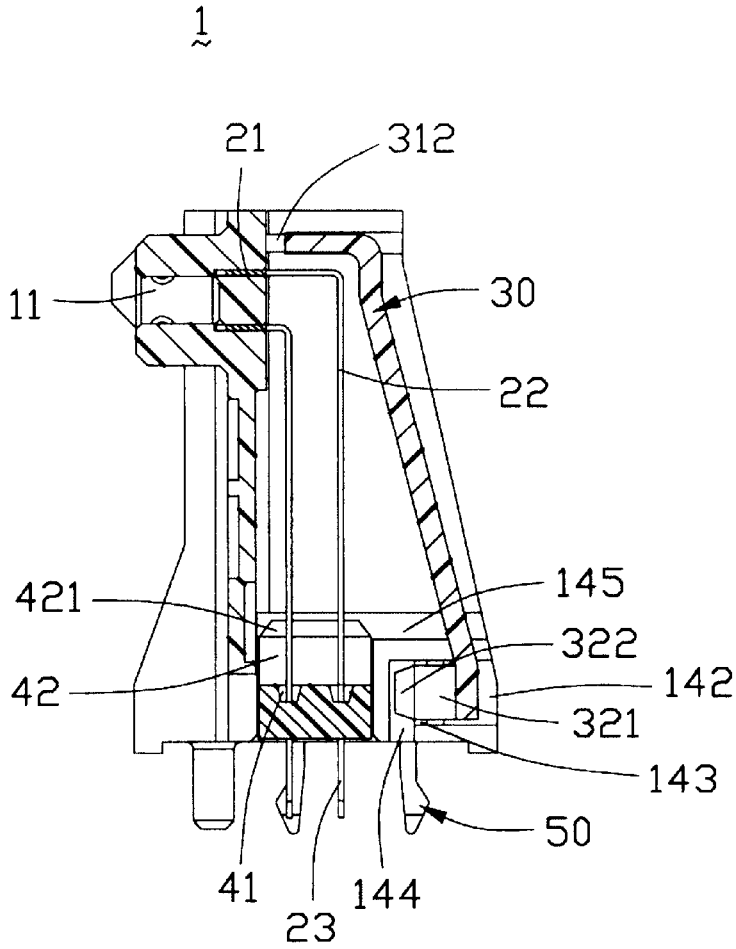
FIG. 6 is a cross-sectional view of the electrical connector taken along line 6—6 of FIG. 5.

Referring to FIG. 6, the terminal 20 received in the housing 10 comprises a contact portion 21, an engaging portion 22 perpendicularly connecting with the contact portion 21, and a tail 23 connecting with the engaging portion 22 and extending out of the insulative housing 10.

Referring to FIGS. 1 to 6, in assembly, the contact portions 21 of the terminals 20 are received in the terminal receiving passageways 13 of the mating portion 11, and the engaging portions 22 perpendicularly extend downwardly. The catch 421 of each arm 42 of the spacer 40 engages the recess 145 of the sidewall 14 of the insulative housing 10, so that the spacer 40 is assembled onto the insulative housing 10 and the tails 23 of the terminals 20 are respectively inserted through the through holes 41 of the spacer 40 to extend out of the insulative housing 10. The tongues 311 of the top ledge 31 of the protector 30 are respectively inserted into the slots 141 of the sidewalls 14 of the insulative housing 10, and the stoppers 312 of the top ledge 31 of the protector 30 abut against the rear face 12 of the insulative housing 10. The latches 321 of the protector 30 are respectively received in the openings 142 of the sidewalls 14, and the hooks 322 of the latches 321 are received in the grooves 144 of the sidewalls 14 and engage the protrusions 143 of the sidewalls 14. Thus, the protector 30 is assembled onto the insulative housing 10 and protects the engaging portions 22 of the terminals 20 from bending. Since the protector 30 is insulative and not a metal cover and the distance between the protector 30 and the terminals 20 is large enough to avoid engagement between the protector 30 and the terminals 20, the electrical connector of the present invention has better and reliable signal transmission quality.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An electrical connector comprising:

an insulative housing comprising a mating portion having a rear face, a plurality of terminal receiving passageways defined in the mating portion, a pair of sidewalls extending rearwardly from the mating portion and a pair of platforms respectively formed outside of the sidewalls, the pair of sidewalls and the rear face of the mating portion together defining a space therebetween;

a plurality of terminals each comprising a contact portion received in a corresponding terminal receiving passageway of the housing, an engaging portion perpendicularly extending from the contact portion and received in the space of the housing, and a tail connecting with the engaging portion and extending out of the insulative housing; and an insulative protector received in the space of the housing and covering the engaging portions of the terminals, the protector comprising a base and a top ledge forwardly extending from the base, the top ledge having a pair of tongues respectively formed on opposite ends thereof, the base having a pair of opposite side latches at the bottom thereof, each latch having a hook at the free end thereof, the tongues of the top ledge and the latches of the base engaging corresponding sidewalls of the insulative housing to assemble the insulative protector to the insulative housing.

2. The electrical connector as claimed in claim 1, wherein each sidewall of the housing defines a slot in the top thereof, a recess in the bottom thereof and an opening in rear of the recess, each opening having a protrusion and a groove disposed therein.

3. The electrical connector as claimed in claim 2, wherein the tongues of the top ledge of the protector are respectively inserted into the slots of the sidewalls of the insulative housing.

4. The electrical connector as claimed in claim 2, wherein the latches of the protector are respectively received in the openings of the sidewalls, and the hooks of the latches are respectively received in the grooves of the sidewalls and engage the protrusions of the sidewalls.

5. The electrical connector as claimed in claim 2, further comprising an elongated spacer, the spacer comprising a plurality of through holes and a pair of arms respectively formed on opposite ends thereof, each arm having a catch received in the recess of a corresponding sidewall of the insulative housing so that the spacer can be assembled to the insulative housing.

6. The electrical connector as claimed in claim 5, wherein the tails of the terminals are respectively inserted through the through holes of the spacer.

7. The electrical connector as claimed in claim 1, further comprising a pair of board locks, and wherein each platform of the housing defines a slit therethrough for receiving a corresponding board lock.

8. The electrical connector as claimed in claim 1, wherein the top ledge of the insulative protector comprises a plurality of stoppers projecting from a front edge thereof, the stoppers abutting against the rear face of the mating portion of the insulative housing.

9. An electrical connector comprising:

an insulative housing including a mating portion and a pair of side walls rearwardly extending from a rear face of the mating portion;

a plurality of terminals disposed in the mating portion, each of said terminals including a tail portion extending rearwardly out of the rear face of the mating portion and located between said pair of side walls;

a spacer defining a plurality of through holes and upwardly assembled to the side walls and receiveably aligning the corresponding tail portions of the terminals, respectively; and a protector including a base and a top ledge projecting from a top edge of the base, said projector assembled to the side walls covering both the tail portions of the terminals and the spacer; wherein said protector includes latches for being releasably latched with the side walls, respectively.

10. The connector as claimed in claim 9, further including means for guiding forwardly assembling of the protector to the housing in a horizontal direction.

11. The connector as claimed in claim 10, wherein said means and said latches are located at different levels of protector.

* * * * *